US008146644B2

(12) United States Patent
Wu

(10) Patent No.: US 8,146,644 B2
(45) Date of Patent: Apr. 3, 2012

(54) FILM TRANSFER TOOL WITH APPLICATION HEAD MOVEABLE BETWEEN EXPOSED AND STOWED POSITIONS

(75) Inventor: Chien-Lung Wu, Chang Hua (TW)

(73) Assignee: SDI Corporation, Chang Hua (TW)

( * ) Notice: Subject to any disclaimer, the term of this patent is extended or adjusted under 35 U.S.C. 154(b) by 211 days.

(21) Appl. No.: 12/465,740

(22) Filed: May 14, 2009

(65) Prior Publication Data

US 2010/0288193 A1 Nov. 18, 2010

(51) Int. Cl.
*B65H 37/00* (2006.01)

(52) U.S. Cl. ..... 156/523; 156/577

(58) Field of Classification Search ..... 156/523, 156/524, 526, 527, 574, 575, 577; 401/109–114, 401/99, 103, 107
See application file for complete search history.

(56) References Cited

U.S. PATENT DOCUMENTS

| | | | | |
|---|---|---|---|---|
| 6,260,599 | B1 | 7/2001 | You | 156/577 |
| 6,622,768 | B2 | 9/2003 | You | 156/577 |
| 7,189,020 | B2 | 3/2007 | Chen | 400/697 |
| 2003/0056906 | A1 | 3/2003 | You | 156/577 |
| 2006/0198685 | A1 | 9/2006 | Fujii | 400/697 |
| 2006/0257195 | A1* | 11/2006 | Chen | 400/697 |
| 2007/0107851 | A1 | 5/2007 | Marschand et al. | 156/577 |
| 2008/0107469 | A1* | 5/2008 | Yoon | 401/104 |

OTHER PUBLICATIONS

Chinese Utility Model Publication No. CN 2728788 Y, Sep. 28, 2005, 7 pages.
Chinese Utility Model Publication No. CN 2752073 Y, Jan. 18, 2006, 16 pages.
Chinese Utility Model Publication No. CN 2799273 Y, Jul. 26, 2006, 13 pages.
Chinese Utility Model Publication No. CN 2841362 Y, Nov. 29, 2006, 8 pages.
European Patent Publication No. EP 1950160 A1, Jul. 30, 2008, 21 pages.
Japanese Patent Publication No. JP 2004/216837, Aug. 5, 2004, 9 pages.
Japanese Patent Publication No. JP 2004/291284, Oct. 21, 2004, 6 pages.
Taiwanese Utility Model Publication No. TW M271730, Aug. 1, 2005, 8 pages.
Taiwanese Utility Model Publication No. TW M311598, May 11, 2007, 10 pages.
Taiwan Utility Model Publication No. TW M311598, May 11, 2007, 10 pages.

* cited by examiner

*Primary Examiner* — Katarzyna Wyrozebski Lee
*Assistant Examiner* — Scott W Dodds
(74) *Attorney, Agent, or Firm* — Alan Kamrath; Kamrath IP Lawfirm, PA

(57) ABSTRACT

A film transfer tool includes an application head, which is adapted to be moved to a stowed position, and a reel assembly having a wall and two stopping members extended therefrom. The reel assembly and a shell have an active member disposed therebetween. The active member has a looped passage on which the two stopping members are adapted to move. The two stopping members can position the reel assembly in a retained position in which the head extends outside the shell, and the reel assembly can be released from the retained position in order that the head is stowed inside the shell.

16 Claims, 17 Drawing Sheets

FILM TRANSFER TOOL WITH APPLICATION HEAD MOVEABLE BETWEEN EXPOSED AND STOWED POSITIONS

BACKGROUND OF THE INVENTION

1. Field of the Invention

The present invention relates to a film transfer tool and, in particular, to a film transfer tool including an application head which is operably moveable between exposed and stowed positions.

2. Description of the Related Art

When correcting mistakes in a pencil-written work, an eraser can be used to wipe out the mistakes easily. When correcting mistakes in a pen-written work, correction fluid can be used. A problem that correction fluid suffers is that the fluid takes time to become solid. Further, the fluid has an unpleasant and harmful odor. A correction tape is an alternative to cover the mistakes, and unlike the correction fluid, the correction tape has no problem of taking time to become solid and of having a harmful odor. Use of the correction tape has gradually substitutes replaced the use of the correction fluid.

U.S. Pat. No. 6,622,768, entitled correction tape roll device, shows two gears that selectively engage so as to reel a correction tape, and this kind of correction tape roll device sets the basic model in the art. However, a problem with this correction tape roll device is that it has a head exposed and causes the correction tape thereon to easily become dirty by dust or other foreign particle.

TW Pat. No. M311598 shows a correction tape dispenser including an application head which automatically moves to a stowed position. The correction tape dispenser includes a front cover with a through slot, a reel assembly with an application head, a retractable device and a rear cover. The reel assembly is mounted in the front cover and partially extends outside the through slot. The retractable device has two ends abutting the core and the rear cover respectively and can control a forward/backward position of the reel assembly. Additionally, the rear cover is connected to the front cover. A user can push the reel assembly to make the retractable device push the application head of the reel assembly and cause the application head to extend from outside the front cover. Thus, it is convenient for the user to push the reel assembly and, therefore, to make the application head of the reel assembly extended. Further, the application head would be retained inside the front cover if it is not used, and the correction tape is maintained clean.

The design of TW Pat. No. M311598 has certainly enabled the application head to selectively move to a stowed position. Unfortunately, the correction tape dispenser has relatively numerous components, and the cost thereof can not be effectively reduced. Then, it will easily lose its competing strength in the stationery market. Moreover, it is impossible to assemble numerous components quickly, and the components increase the cost of manufacturing.

The present invention is, therefore, intended to obviate or at least alleviate the problems by providing a design which reduces the cost of manufacturing, uses fewer components, and enables the application head to move to a stowed position as well.

SUMMARY OF THE INVENTION

According to the present invention, it is an object of the present invention to provide a film transfer tool which reduces the cost of manufacturing, uses fewer components, and enables an application head to move to a stowed position as well.

A film transfer tool includes an application head which is adapted to be moved to a stowed position and a reel assembly having a wall and two stopping members extended therefrom. The reel assembly and a shell have an active member disposed therebetween. The active member has a looped passage that the two stopping members are adapted to move on. The two stopping members can position the reel assembly in a retained position in which the head extends outside the shell, and the reel assembly can be released from the retained position in order that the head is stowed inside the shell.

Additionally, a force-applied member utilized to control the reel assembly and the positioning of the two stopping members of the reel assembly with respect to the active member enables the head to be stowed.

DETAILED DESCRIPTION OF THE PREFERRED EMBODIMENT

While the best embodiments will be illustrated and described with reference to the drawings hereafter, numerous modifications come to mind without significantly departing from the spirit of invention, and the scope of invention is not limited by the specific embodiments.

Figure 1:
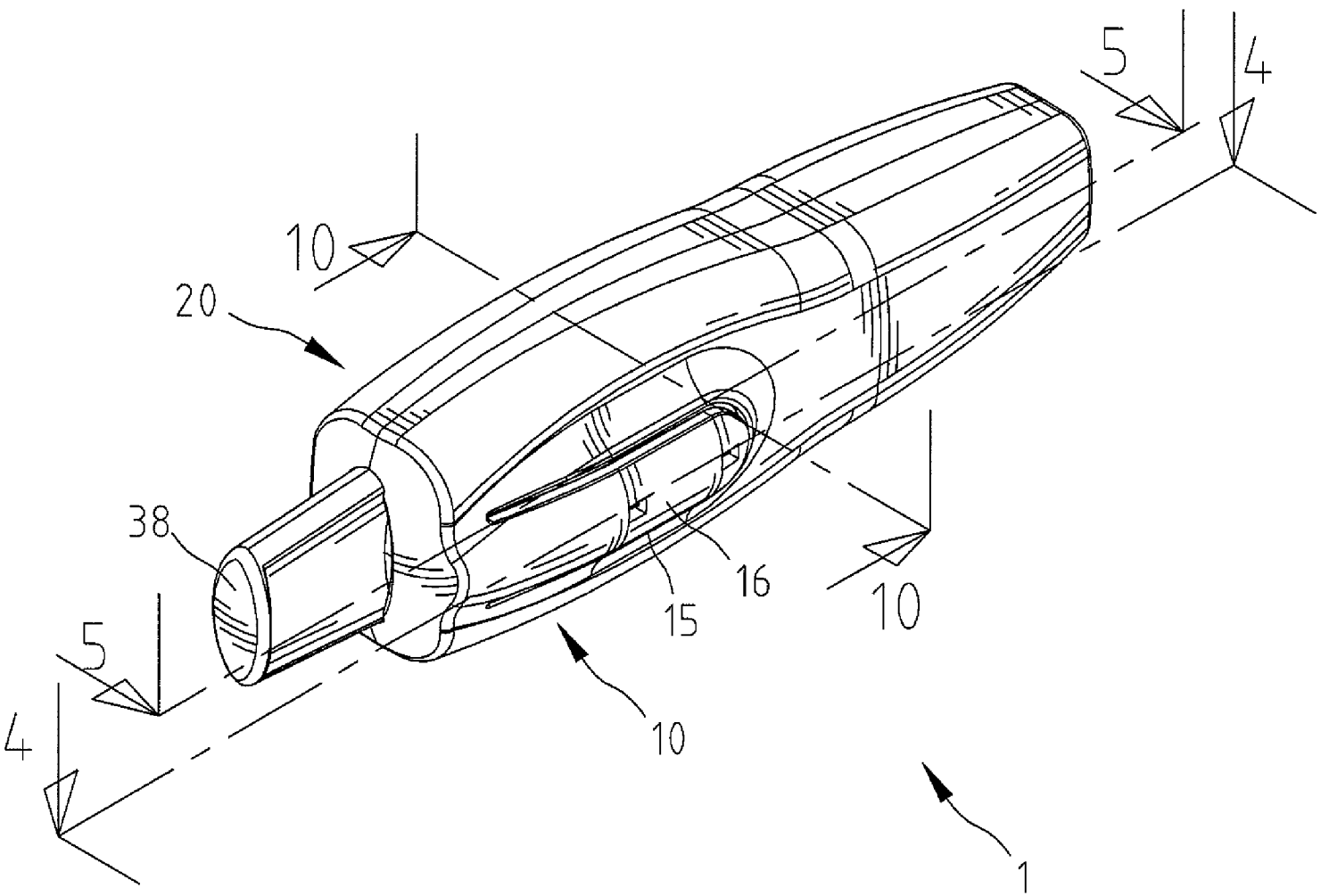
FIG. 1 is a perspective view of a film transfer tool in accordance with a first embodiment of the present invention.
Figure 2:
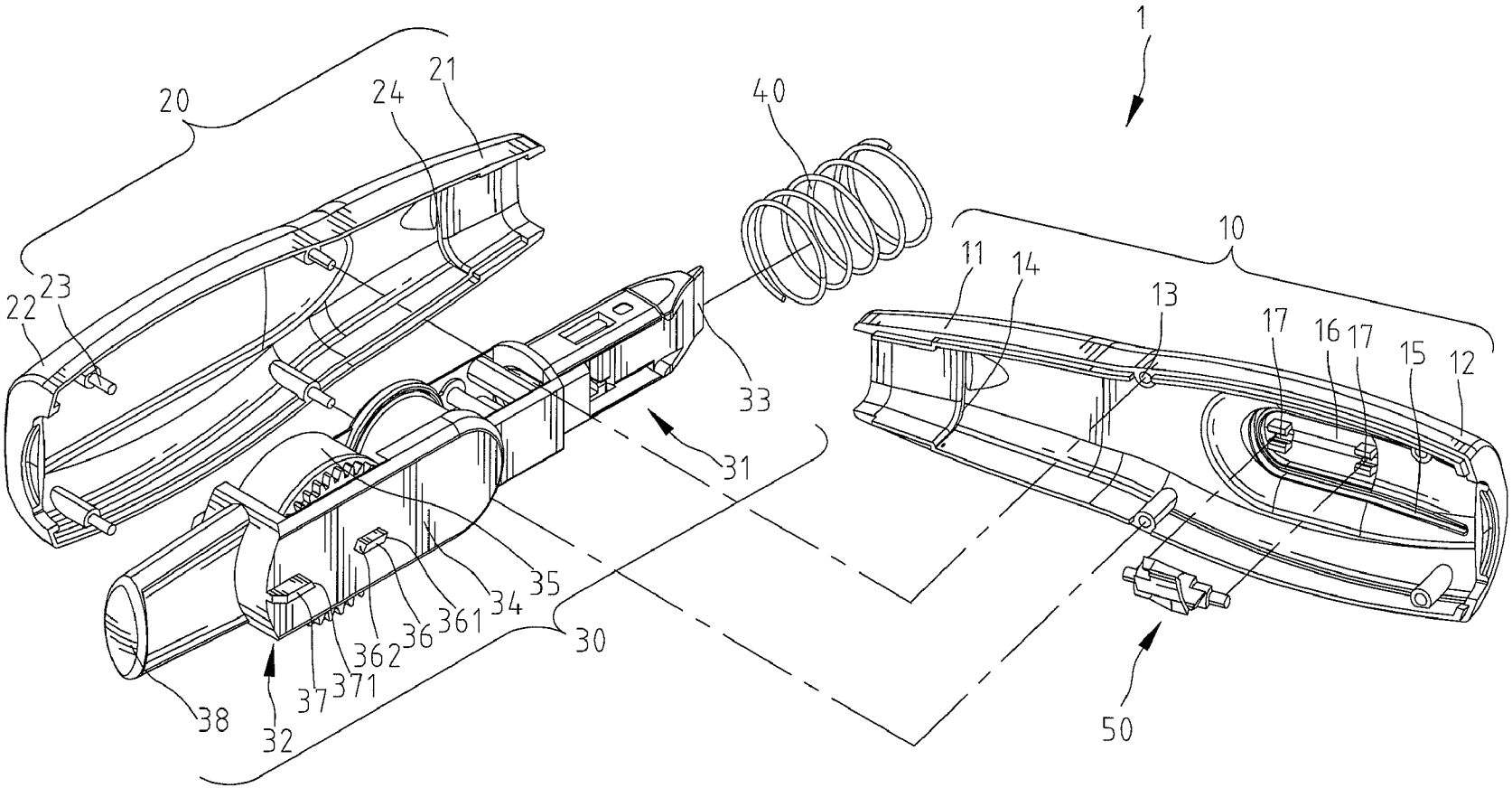
FIG. 2 is an exploded perspective view of the film transfer tool shown in FIG. 1.

FIGS. 1 and 2 show a perspective view and an exploded perspective view of a film transfer tool 1 in accordance with a first embodiment of the present invention. The first embodiment of the film transfer tool 1 of the present invention includes a housing including a first shell 10 and a second shell 20. The first and second shells 10 and 20 are configured to be connected to each other. However, the housing may be formed of a single shell. The first and second shells 10 and 20 cover a reel assembly 30, an elastic element 40, and an active member 50.

The first and second shells 10 and 20 each includes a first end 11 and 21 and a second end 12 and 22 having an opening. A plurality of engaging holes 13 are disposed on an inner periphery of the first shell 10. A plurality of engaging tenons 23 are disposed on an inner periphery of the second shell 20. Additionally, the plurality of engaging tenons 23 are engagable in the plurality of engaging holes 13 respectively in order to enable the first and second shells 10 and 20 to be connected to each other. Thus, the reel assembly 30 and the elastic element 40 are received in the inner peripheries of the first and second shells 10 and 20. Furthermore, the first and second shells 10 and 20 each includes a recess 14 and 24 formed on the inner periphery. The recesses 14 and 24 prevent the elastic element 40 from moving out of the first and second shells 10 and 20.

The first shell 10 includes a substantially U-shaped groove 15 in the vicinity to the second end 12. Further, an elastic plate 16 is surrounded by the U-shaped groove 15. Further, two pivotal connections 17 are formed on an inner surface of the elastic plate 16.

The reel assembly 30 includes a first end 31 and a second end 32. An application head 33 is disposed at the first end 31 of the reel assembly 30 and is inserted through the elastic element 40. A receiving frame 34 is disposed at the second end 32 of the reel assembly 30 and is utilized for receiving a correction tape 35. Furthermore, the elastic element 40 is abutted by the receiving frame 34. Further, first and second stopping members 36 and 37 are extended from a wall of the receiving frame 34, with the wall of the receiving frame 34 being in proximity to the first shell 10. The first stopping member 36 includes two slanted edges 361 and 362 at two ends thereon respectively. The second stopping member 37 includes an end, which is in proximity to the first stopping member 36, having a slanted edge 371. Moreover, the first stopping member 36 is extended from the wall of the receiving frame 34 at a first height, whereas the second stopping member 37 is extended from the wall of the receiving frame 34 at a second height, and with the second height greater than the first height. A force-applied member 38 is disposed at an end of the receiving frame 34, and the force-applied member 38 is disposed at the second end 32 of the reel assembly 30 and is opposite to the application head 33. Moreover, the force-applied member 38 is disposed at an end of the film transfer tool 1 and is adapted to be operably pushed.

Figure 3:
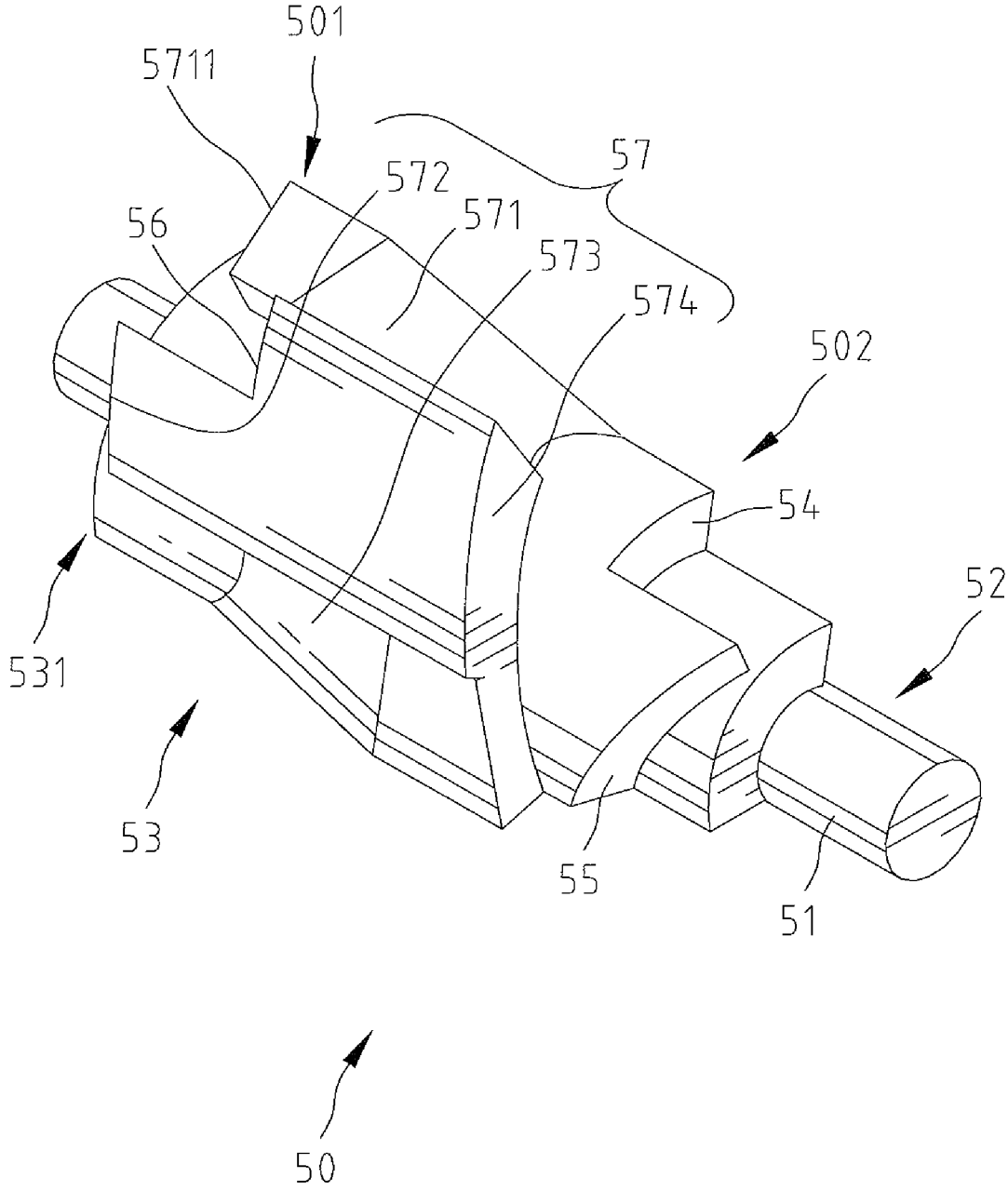
FIG. 3 is a perspective view of an active member of the film transfer tool.

FIG. 3 shows a perspective view of the active member 50. The active member 50 is restrained in the two pivotal connections 17 on the first shell 10. Thus, the active member 50 is not only prevented from coming off the two pivotal connections 17 but also is pivotal with respect to the two pivotal connections 17. The active member 50 includes a spindle 51 having two ends engaged in the two pivotal connections 17 respectively. Additionally, the spindle 51 has an arcuate face 52 defining one peripheral side and an activating face 53 defining another peripheral side. The arcuate face 52 is in proximity to the elastic plate 16 on the first shell 10, whereas the activating face 53 is in proximity to the reel assembly 30. The active member 50 includes a first end 501 and a second end 502. Also, the activating face 53 is uneven. Moreover, the active member 50 is adapted to be injection molded and accomplishes a goal for mass production in a rapid manner. The activating face 53 includes a stopping section 54, an urged section 55, a locking section 56 and a looped passage 57. The looped passage 57 includes an entry track 571, a guiding track 572, an exit track 573 and a pivoting track 574. The entry track 571 has a starting end in proximity to the stopping section 54 and a finishing end in proximity to the locking section 56. The locking section 56 is disposed between the entry track 571 and the guiding track 572. Additionally, the entry track 571 is slanted away from the spindle 51 as it extends from the second end 502 to the first end 501 of the active member 50. Further, a guiding section 5711 is formed at a finishing end of the entry track 571. The locking section 56 is disposed at the first end 501 of the active member 50 and includes a slanted face. The stopping section 54 and the urged section 55 are disposed at the second end 502 of the active member 50 and are in communication with each other. The guiding track 572 is disposed at the first end 501 of the active member 50 and communicates the locking section 56 and the exit track 573. Additionally, the exit track 573 is slanted away from the spindle 51 as it extends from the first end 501 to the second end 502 of the active member 50. Also, the pivoting track 574 is disposed at the second end 502 of the active member 50 and communicates the entry track 571 and the exit track 573. Additionally, the pivoting track 574 is slanted toward the entry track 571 as it extends from the exit track 573 to the entry track 571.

Figure 4:
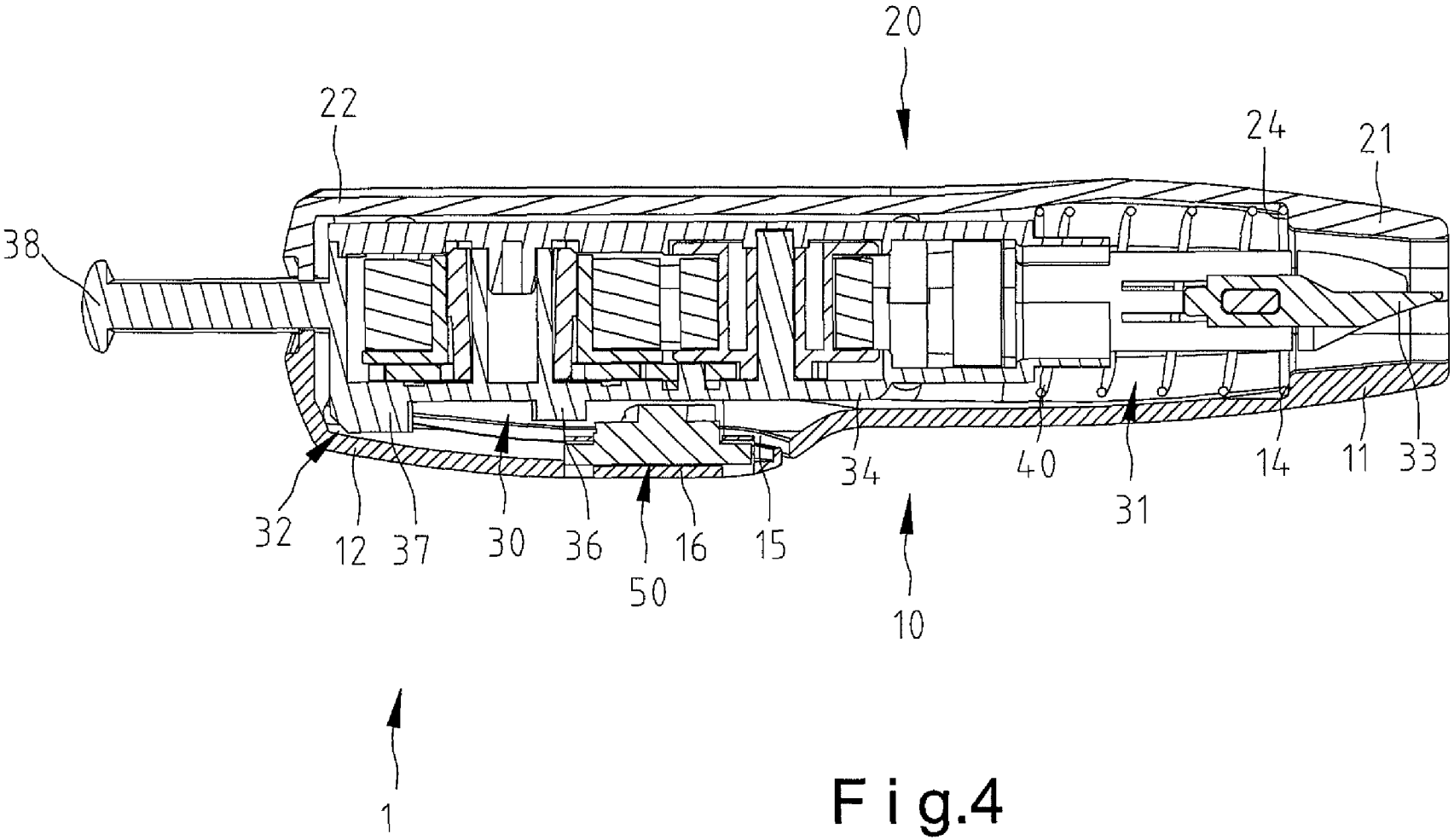
FIG. 4 is a cross-sectional view taken along line 4-4 in FIG. 1 and in which an application head is stowed inside a shell.
Figure 5:
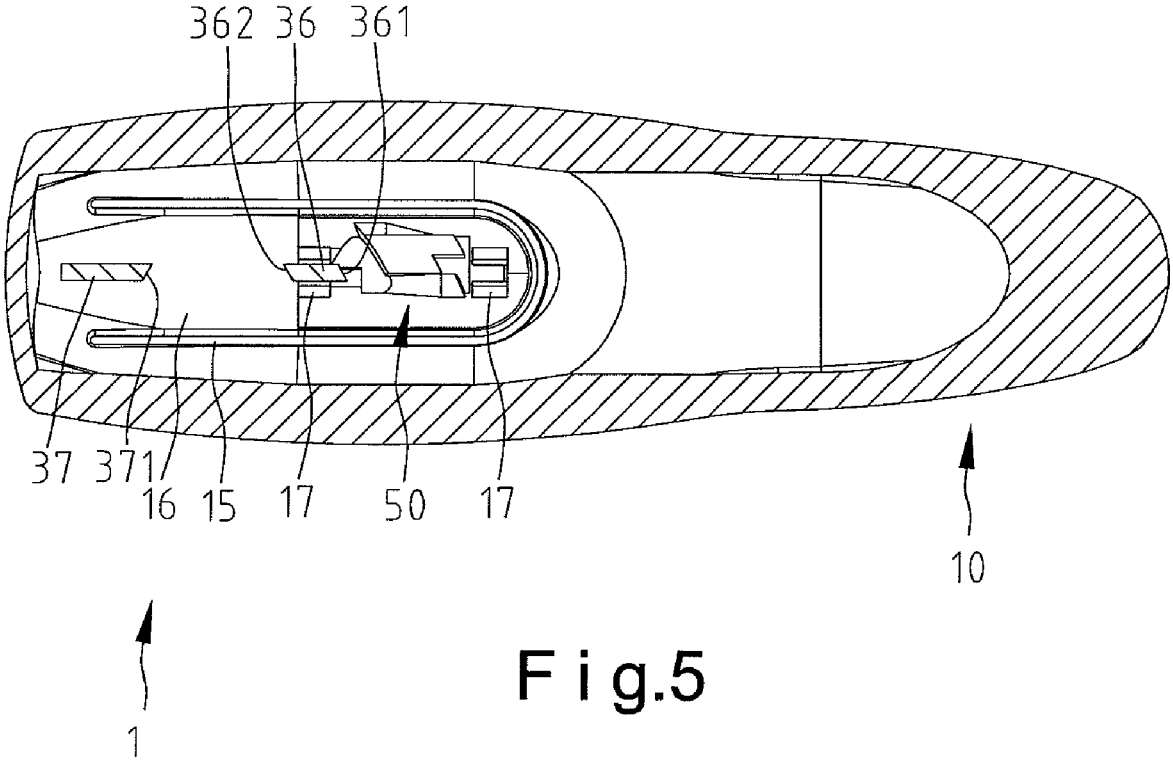
FIG. 5 is a cross-sectional view taken along line 5-5 in FIG. 1, showing stopping members and the active member.
Figure 6:
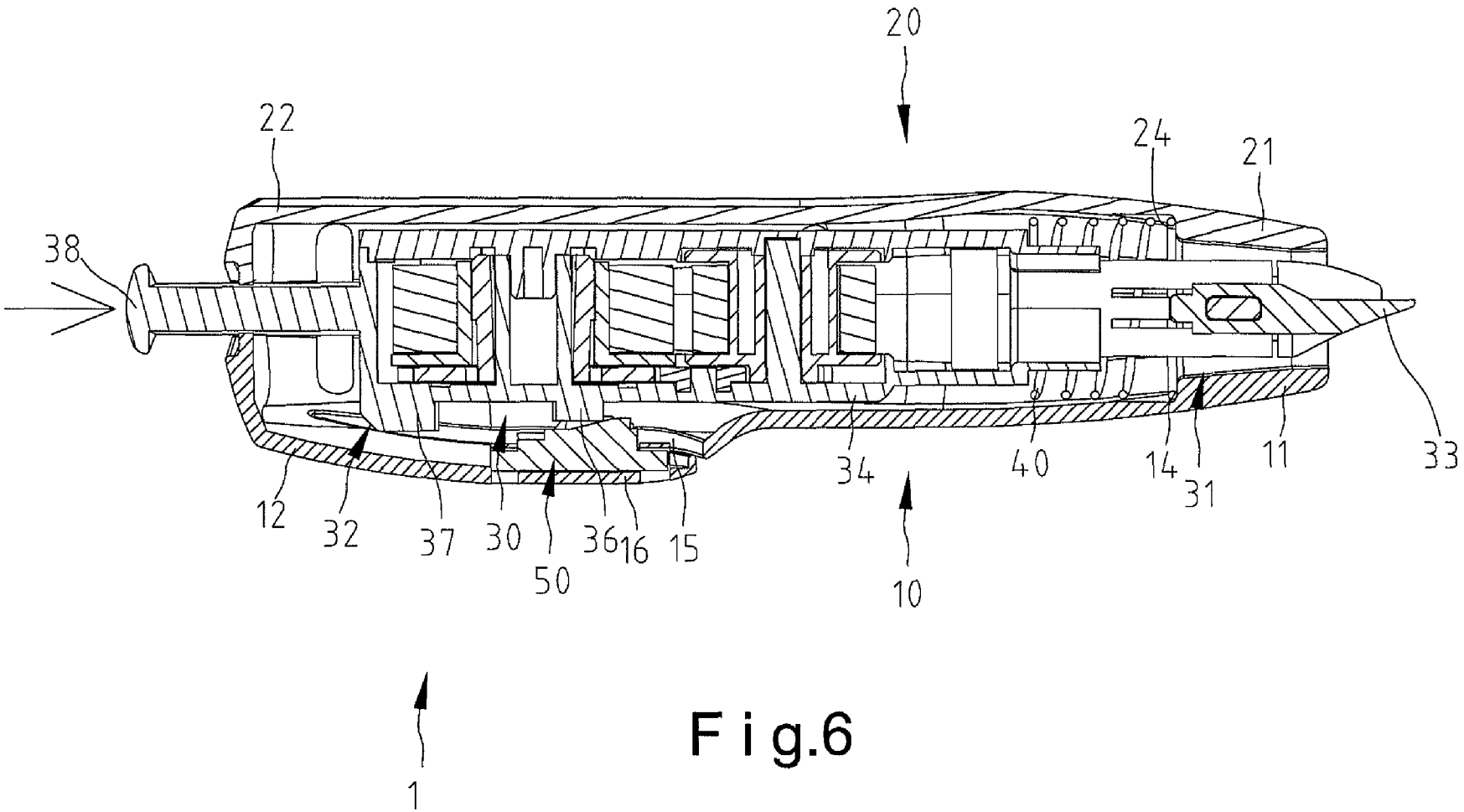
FIG. 6 is an extended cross-sectional view of FIG. 4 and in which the application head is extended outside the shell.
Figure 7:
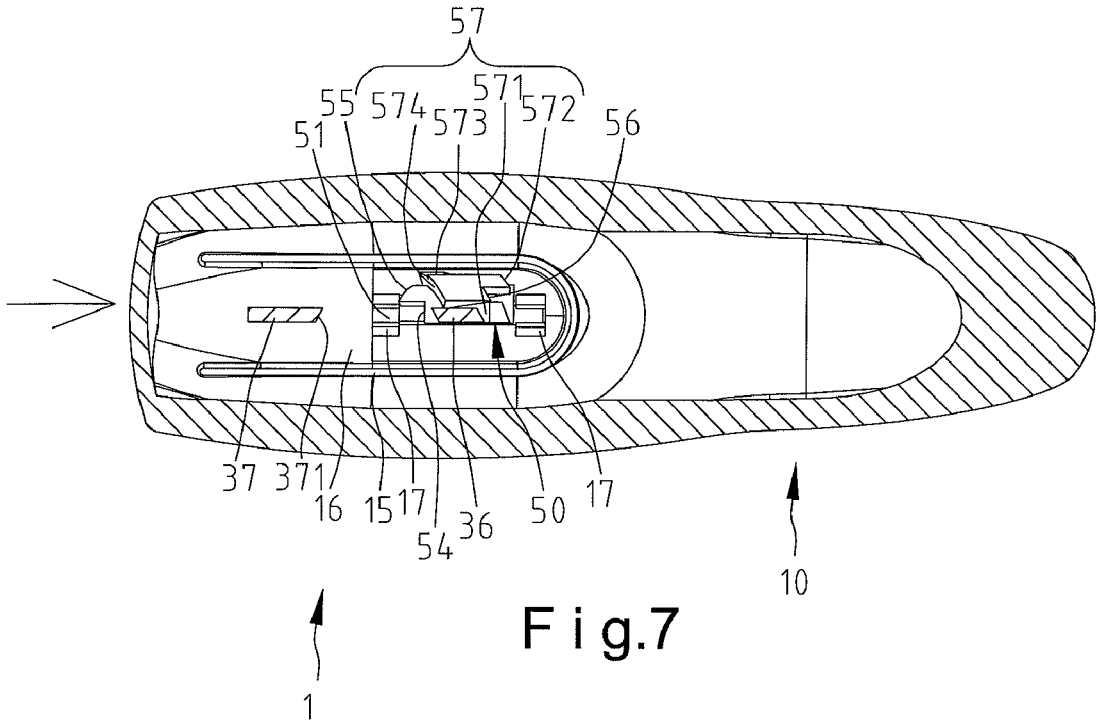
FIG. 7 is an extended cross-sectional view of FIG. 5 and shows the operational movement of the stopping members with respect to the active member.
Figure 8:
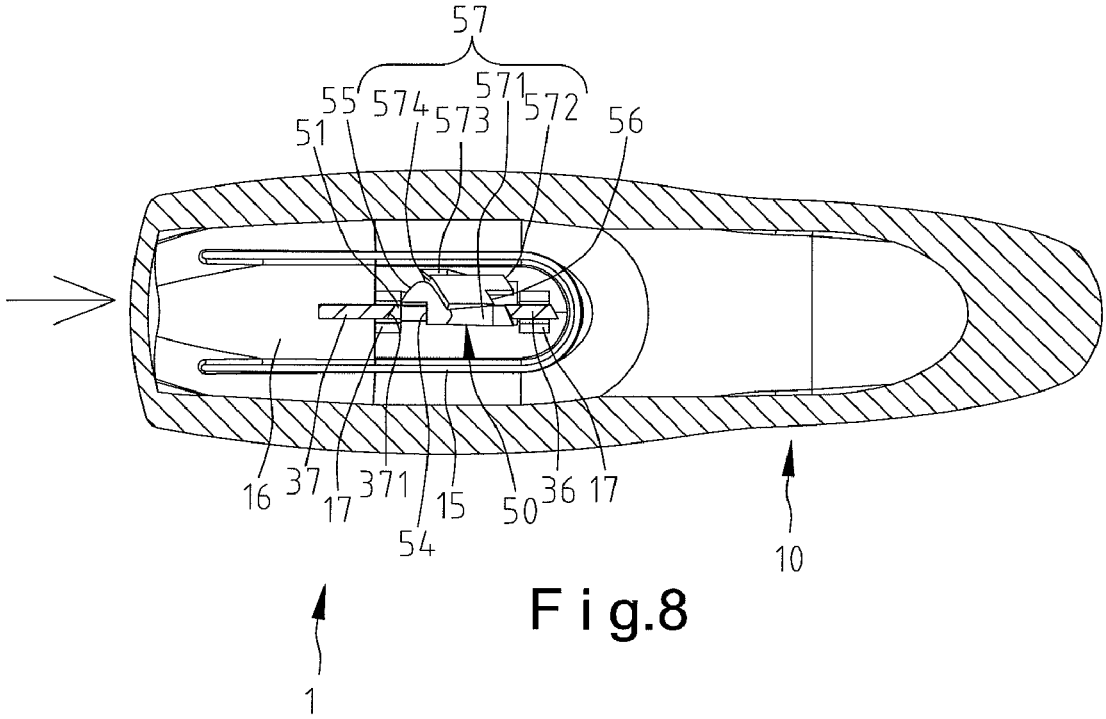
FIG. 8 is an extended cross-sectional view of FIG. 7 and in which the active member has passed an entry track of the passage of the active member.
Figure 9:
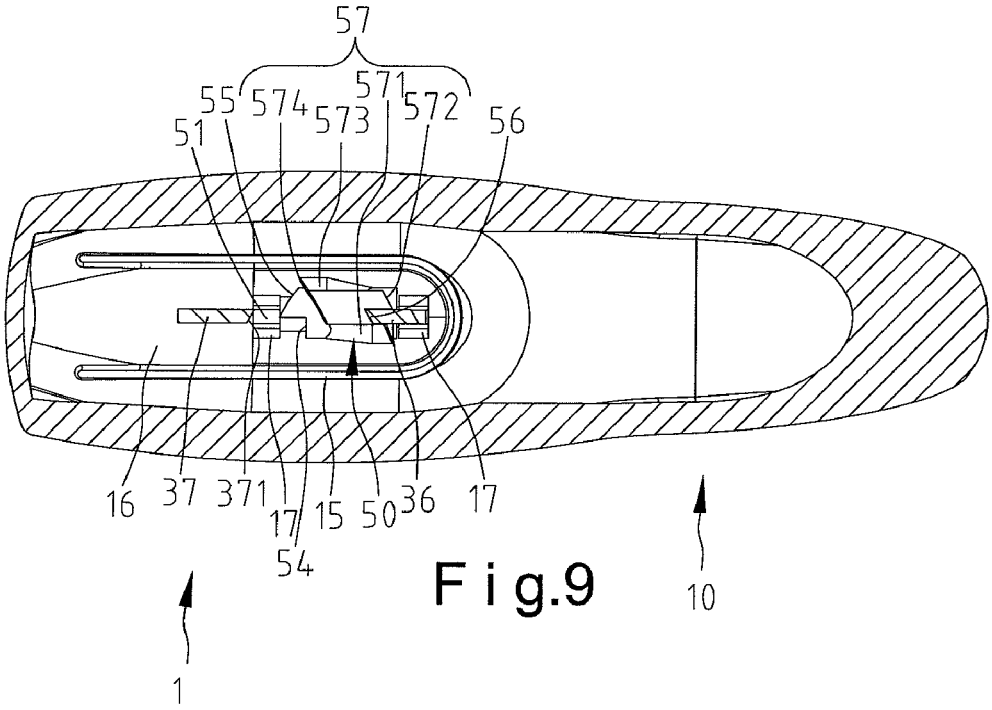
FIG. 9 is an extended cross-sectional view of FIG. 8 and in which a first stopping member is restrained on the active member.

FIGS. 4 and 5 show the application head 33 of the film transfer tool 1 stowed inside the first and second shells 10 and 20. The reel assembly 30 is biased by the return of the elastic element 40 and is moved toward the second ends 12 and 22 of the first and second shells 10 and 20 when removing from the force-applied member 38. Thus, the application head 33 of the reel assembly 30 is stowed inside the first and second shells 10 and 20.

Figure 10:
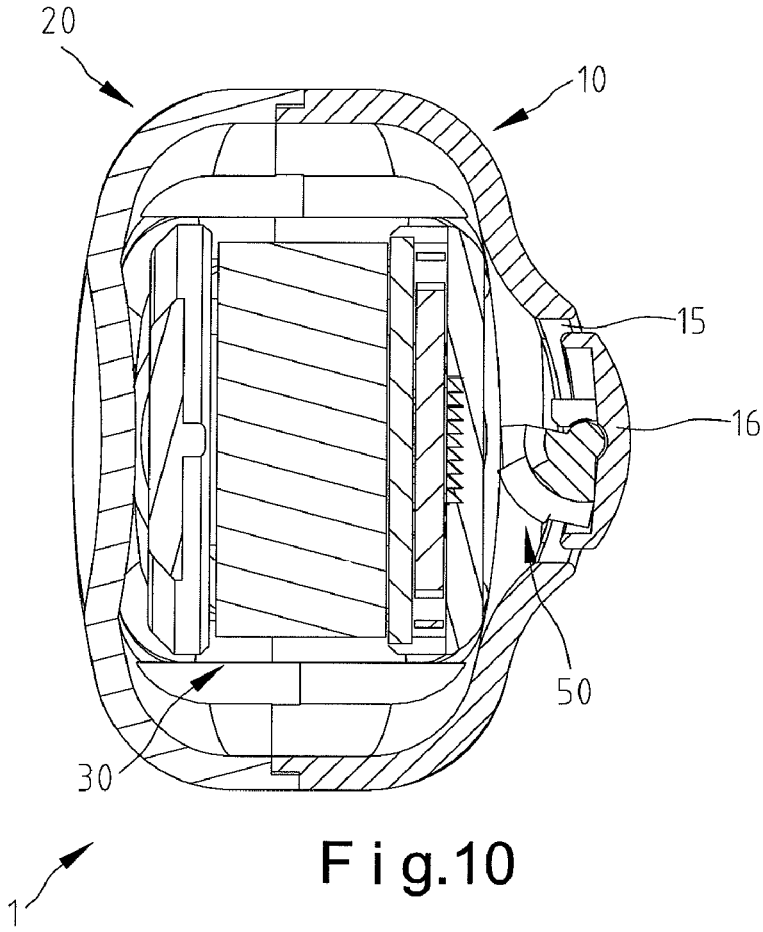
FIG. 10 is a cross-sectional view taken along line 10-10 in FIG. 1 showing a U-shaped groove and an elastic plate.
Figure 11:
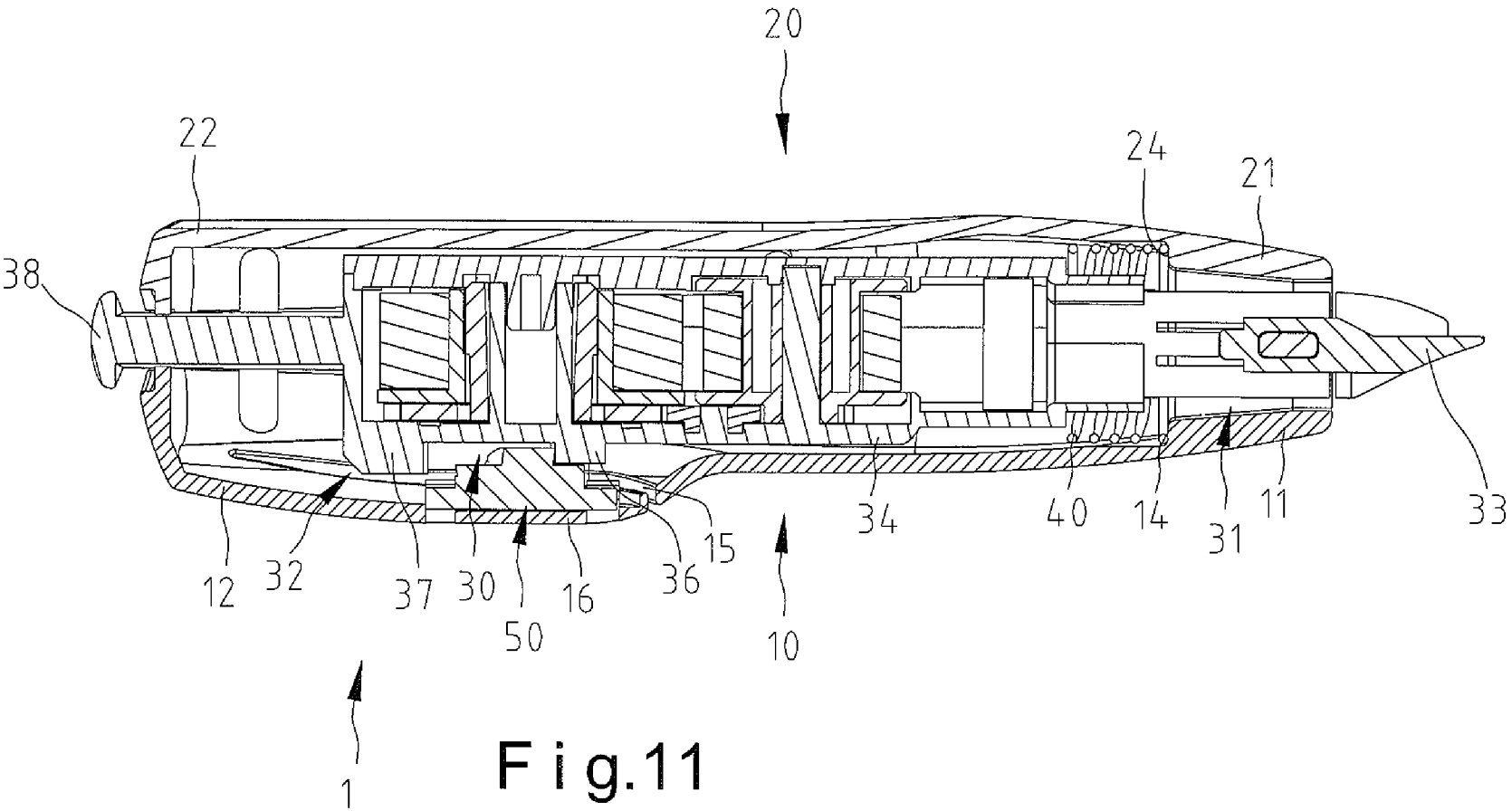
FIG. 11 is an extended cross-sectional view of FIG. 7 and shows a state when a force-applied member is pressed continuously.
Figure 12:
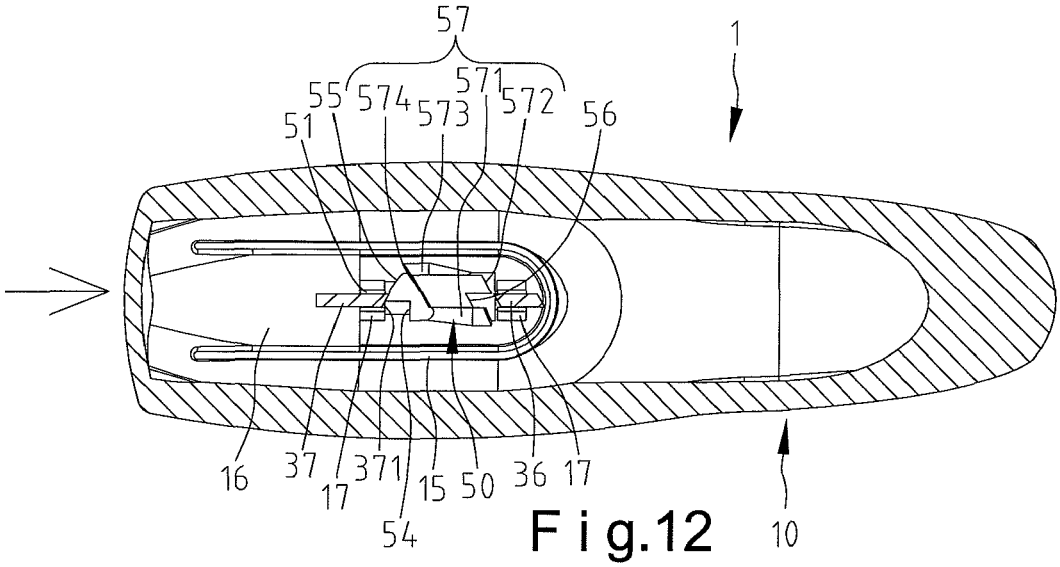
FIG. 12 is an extended cross-sectional view of FIG. 11 and in which the first stopping member is released from a retained position with respect to the active member.
Figure 13:
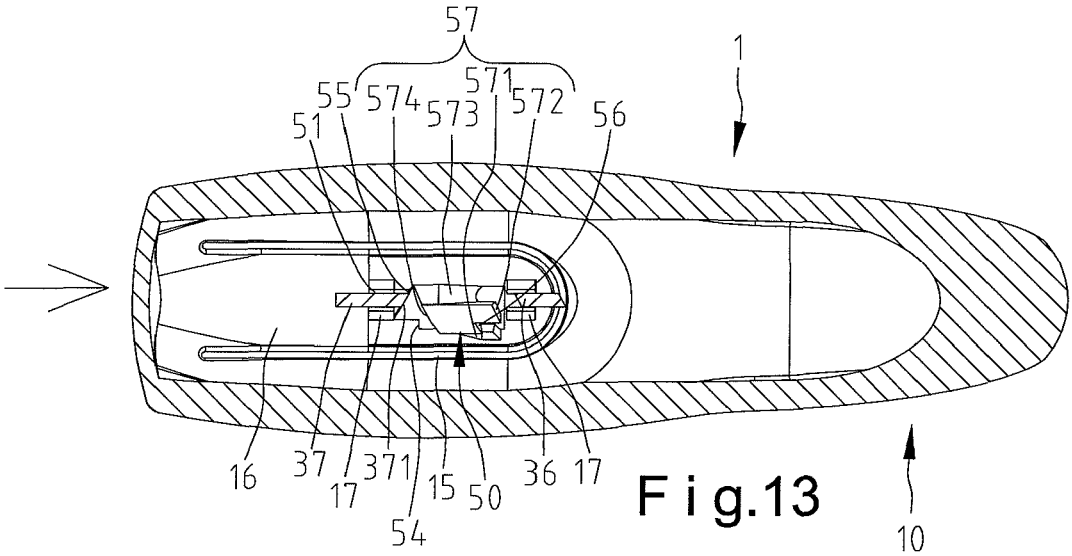
FIG. 13 is an extended perspective view of FIG. 12 and in which a second stopping member is pushed against the active member.
Figure 14:
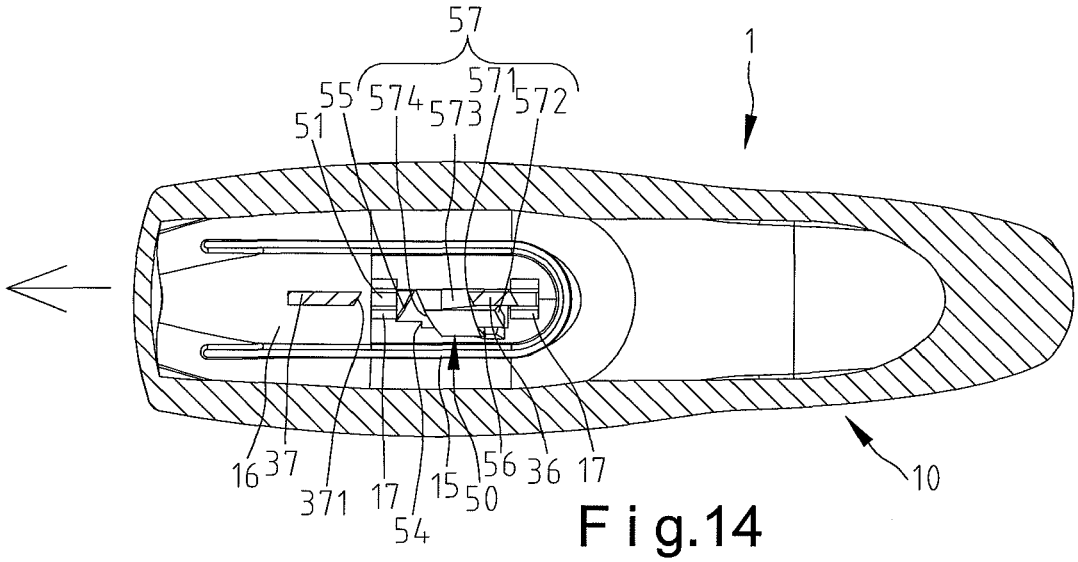
FIG. 14 is an extended perspective view of FIG. 13 and in which the first stopping member has entered an exit track of the passage of the active member.

FIGS. 6 through 9 show the operation of the film transfer tool 1 and the application head 33 extended outside the first and second shells 10 and 20. A user uses the force-applied member 38 to move the reel assembly 30 from the second ends 12 and 22 to the first ends 11 and 21 of the first and second shells 10 and 20. The first stopping member 36 on the receiving frame 34 of the reel assembly 30 is moved on the passage 57 and causes the pivoting of the active member 50. Additionally, when the active member 50 is pivoted, the elastic plate 16 is urged, and the U-shaped groove 15 on the first shell 10 allows the elastic plate 16 to be urged outwardly (refer to FIG. 10).

When the force-applied member 38 is moved, the pivoting track 574 of the active member 50 is urged by the first stopping member 36. The first stopping member 36 is thereafter pivoted into the entry track 571 of the active member 50.

When the force-applied member 38 is continuously moved, the first stopping member 36 is moved past the entry track 571 and the second stopping member 37 is stopped by the stopping section 54. As mentioned, the second height is greater than the first height. Thus, the second stopping member 37 is stopped by the stopping section 54 and the second stopping member 37 stops the proceeding of the reel assembly 30 moving to the first ends 11 and 21 of the first and second shells 10 and 20. Meanwhile, the slanted edge 362 of the first stopping member 36 is abutted by the guiding section 5711. The first stopping member 36 is thereafter guided thereafter into the locking section 56 and the second stopping member 37 is concurrently disengaged from the stopping section 54. Thus, when the first stopping member 36 is engaged in the locking section 56, the reel assembly 30 is retained and the application head 33 is extended outside the first and second shells 10 and 20.

When the force-applied member 38 is moved, the pivoting track 574 of the active member 50 is urged by the first stopping member 36. The first stopping member 36 is thereafter pivoted into the entry track 571 of the active member 50. When the force-applied member 38 is continuously moved, the first stopping member 36 is moved past the entry track 571, and the second stopping member 37 is stopped by the stopping section 54. As mentioned, the second height is greater than the first height. Thus, the second stopping member 37 is stopped by the stopping section 54, and the second stopping member 37 stops the proceeding of the reel assembly 30 moving to the first ends 11 and 21 of the first and second shells 10 and 20. Meanwhile, the slanted edge 362 of the first stopping member 36 is abutted by the guiding section 5711. The first stopping member 36 is thereafter guided into the locking section 56 and the second stopping member 37 is concurrently disengaged from the stopping section 54. Thus, when the first stopping member 36 is engaged in the locking section 56, the reel assembly 30 is retained, and the application head 33 is extended outside the first and second shells 10 and 20.

FIGS. 11 through 14 show the operation of the film transfer tool 1 and the application head 33 stowed inside the first and second shells 10 and 20. The user moves the force-applied member 38 again to move the first and second stopping members 36 and 37 toward a first end 531 of the activating face 53. The first stopping member 36 is thereafter disengaged from the locking section 56, and the slanted edge 371 of the second stopping member 37 is abutted by the urged section 55. The slanted edge 362 of the first stopping member 36 is thereafter abutted by the guiding track 572, and the first stopping member 36 is guided into the exit track 573. Then, the reel assembly 30 is biased to the second ends 12 and 22 of the first and second shells 10 and 20 by the return of the elastic element 40. Consequently, the first stopping member 36 is moved past the exit track 573, and the application head 33 is stowed inside the first and second shells 10 and 20.

Figure 15:
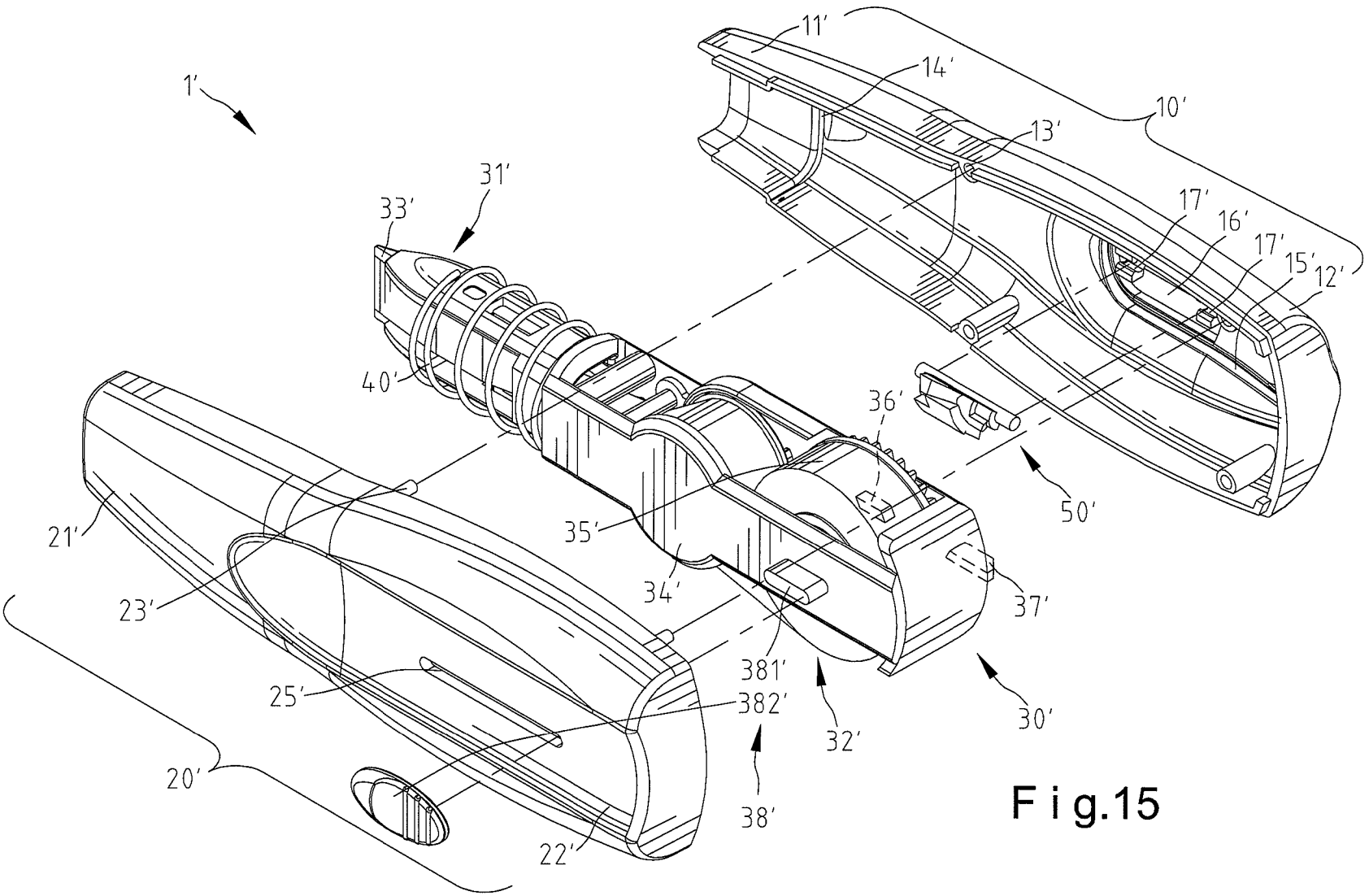
FIG. 15 is an exploded perspective view of a film transfer tool in accordance with a second embodiment of the present invention.
Figure 16:
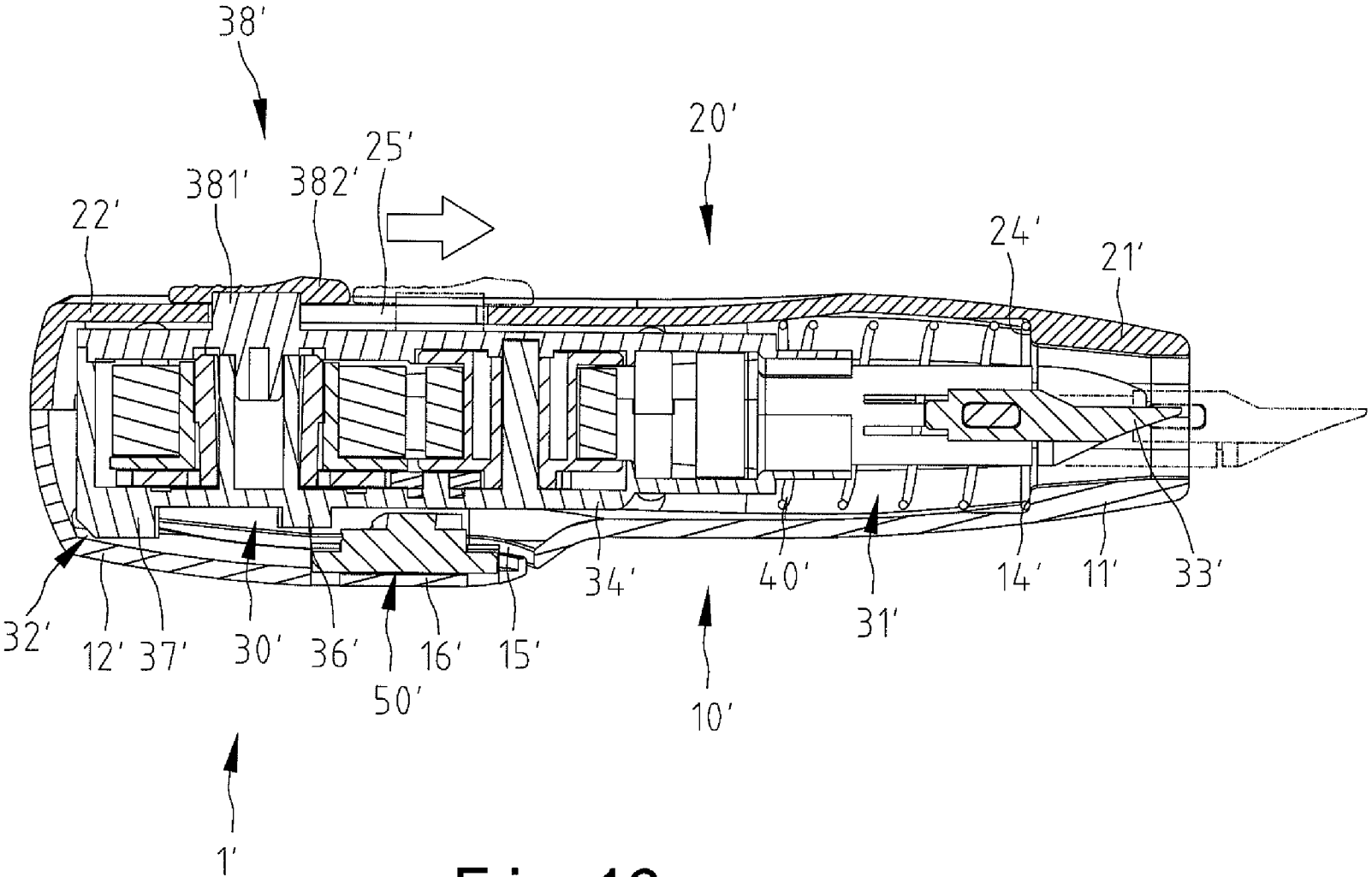
FIG. 16 is a cross-sectional view shows the operation of the film transfer tool show in FIG. 15.
Figure 17:
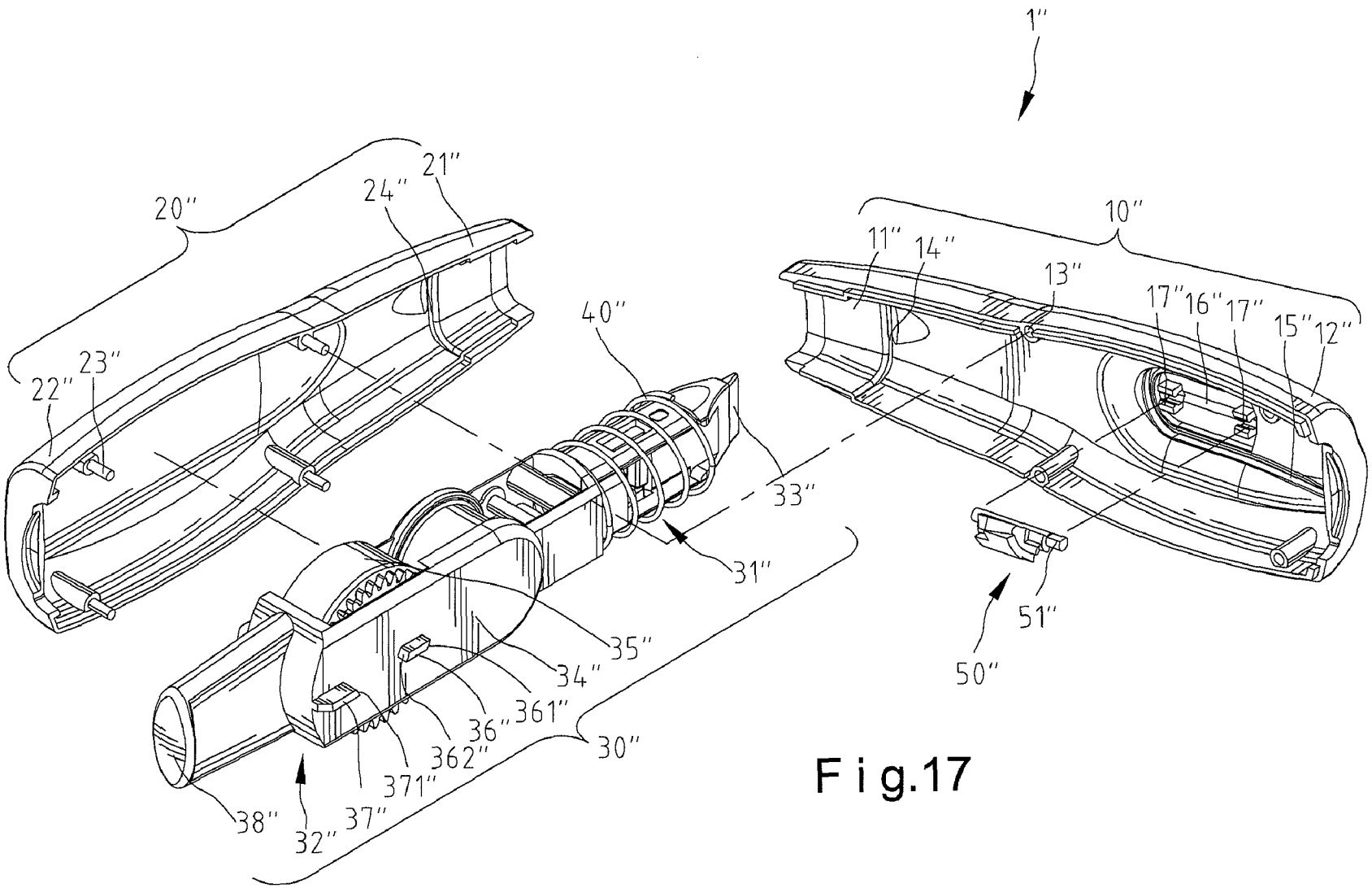
FIG. 17 is an exploded perspective view of a film transfer tool in accordance with a third embodiment of the present invention.
Figure 18:
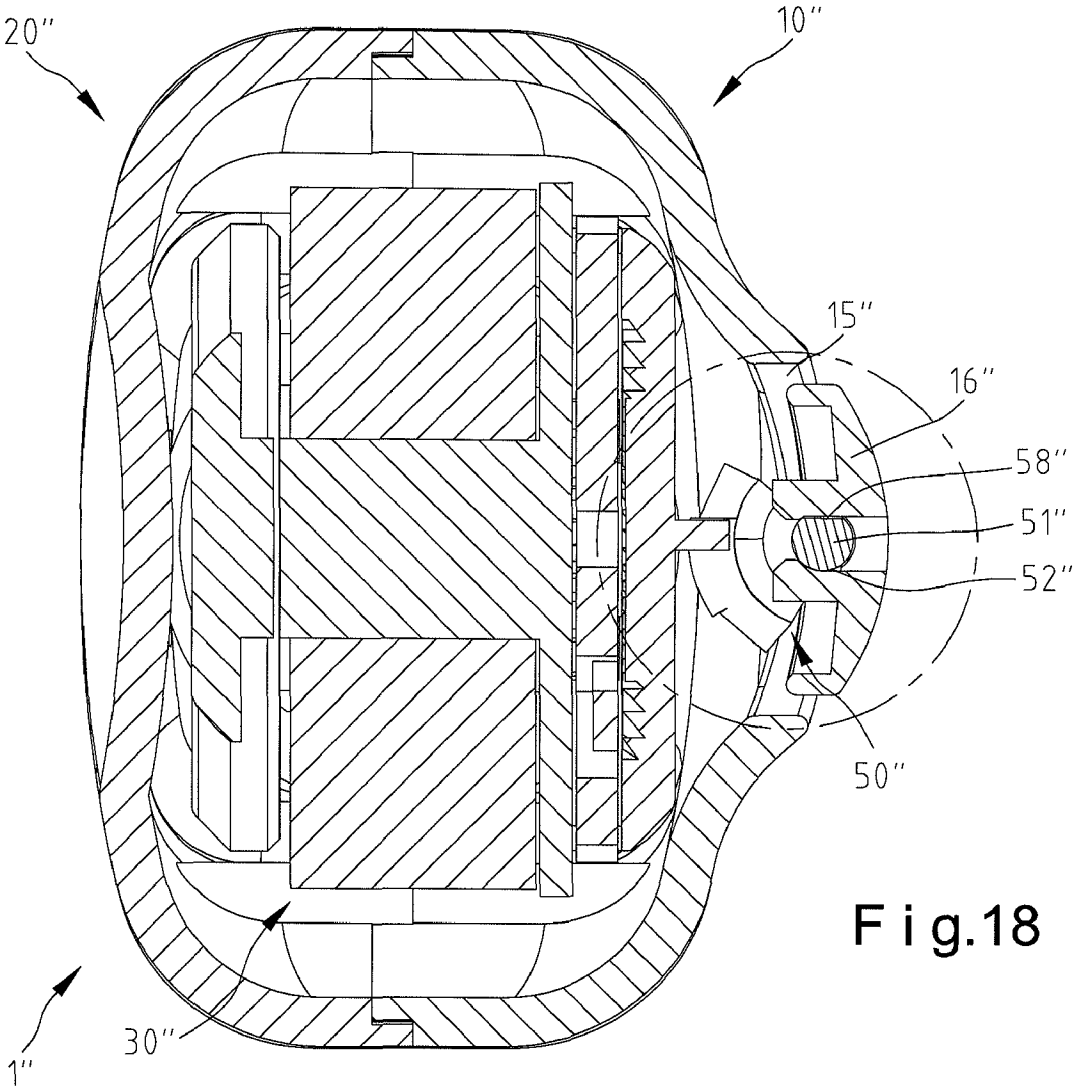
FIG. 18 is a cross-sectional view of the film transfer tool shown in FIG. 17.
Figure 19:
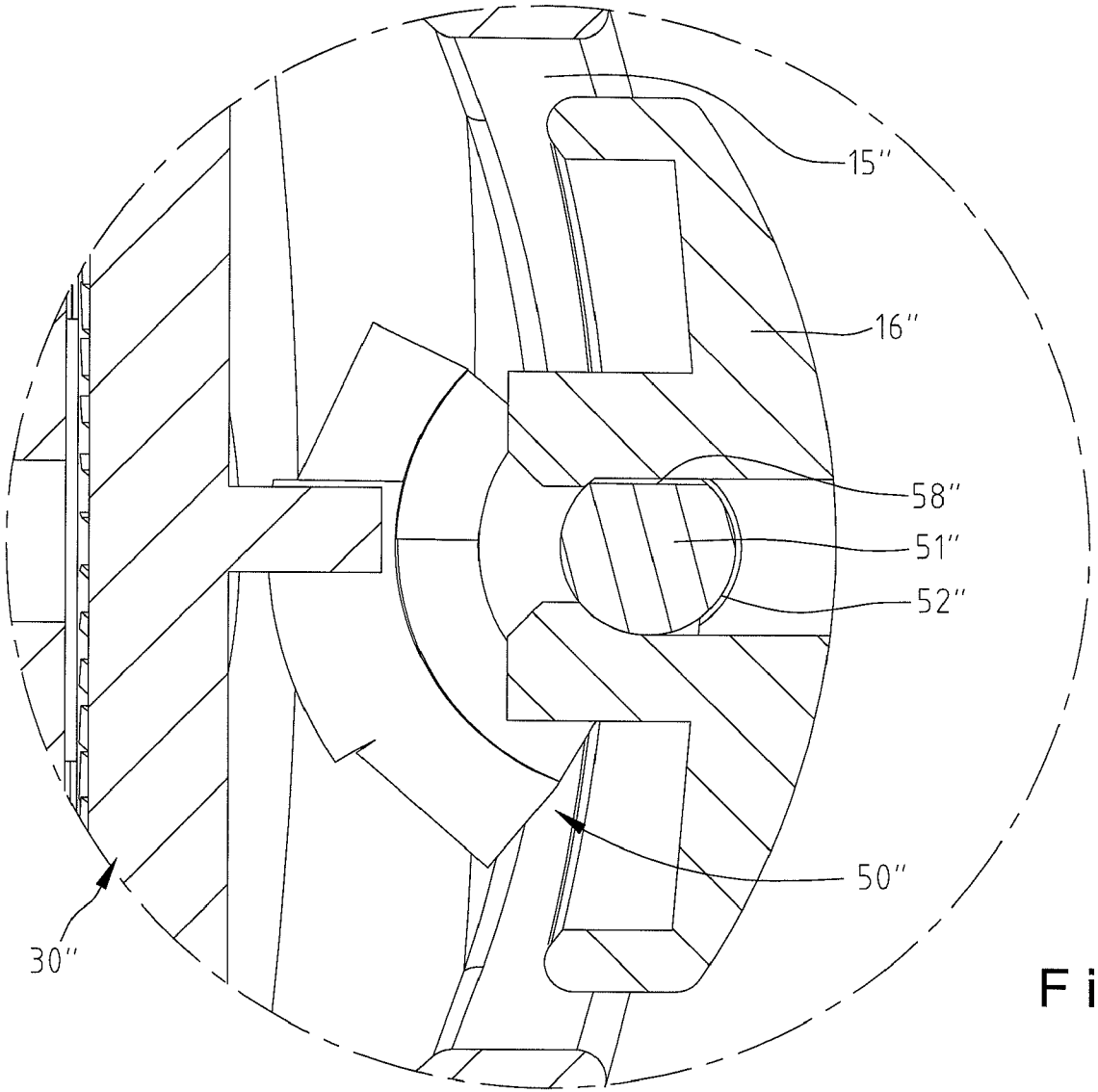
FIG. 19 is a partial, enlarged view of the film transfer tool shown in FIG. 18.

FIGS. 15 and 16 show a film transfer tool 1' in accordance with a second embodiment of the present invention, wherein like numerals are employed to denote like components of the first embodiment, however bearing the prime. The second embodiment differentiates from the first embodiment in that it includes a force-applied member 38' which is disposed on a lateral side of film transfer tool 1'. A first shell 10' and a second shell 20' each includes a second end 12' and 22'. When the first and shells 10' and 20' are connected to each other, the second ends 12' and 22' are closed. Further, a through slot 25' is disposed on a wall of the second end 22' of the second shell 20'. Other components of the first and second shells 10' and 20' are the same as those of the first embodiment.

A reel assembly 30' which differentiates from the first embodiment in that the reel assembly 30' includes a second end 32' on which the force-applied member 38' is disposed. The force-applied member 38' includes a protruding section 381' extended from a wall of the receiving frame 34' and inserted through the through slot 25' on the second shell 20'. Further, a pushing member 382' is engaged with the protruding section 381'. When the pushing member 382' is moved toward first ends 11' and 21' of the first and second shells 10' and 20', the protruding section 381' is moved, and the reel assembly 30' is operably moved in the first and second shells 10' and 20'. Likewise, the first and second stopping members 36' and 37' on the reel assembly 30' are adapted to be retained by an active member 50' such that an application head 33' is retained and extended outside the first and second shells 10' and 20'. When the pushing member 382' is continuously moved toward the first ends 11' and 21' of the first and second shells 10' and 20', the first and second stopping members 36' and 37' are released from retained engagement with the active member 50', and the reel assembly 30' is biased by the return of an elastic element 40' and is moved toward the second ends 12' and 22' of the first and second shells 10' and 20'. Thus, the application head 33' is stowed inside the first and second shells 10' and 20'. Additionally, since the operation of first and second stopping members 36' and 37' on the reel assembly 30' with respect to the active member 50' and the operational movement of the elastic element 40' are the same as the first embodiment, descriptions relating thereto are reserved.

Figure 20:
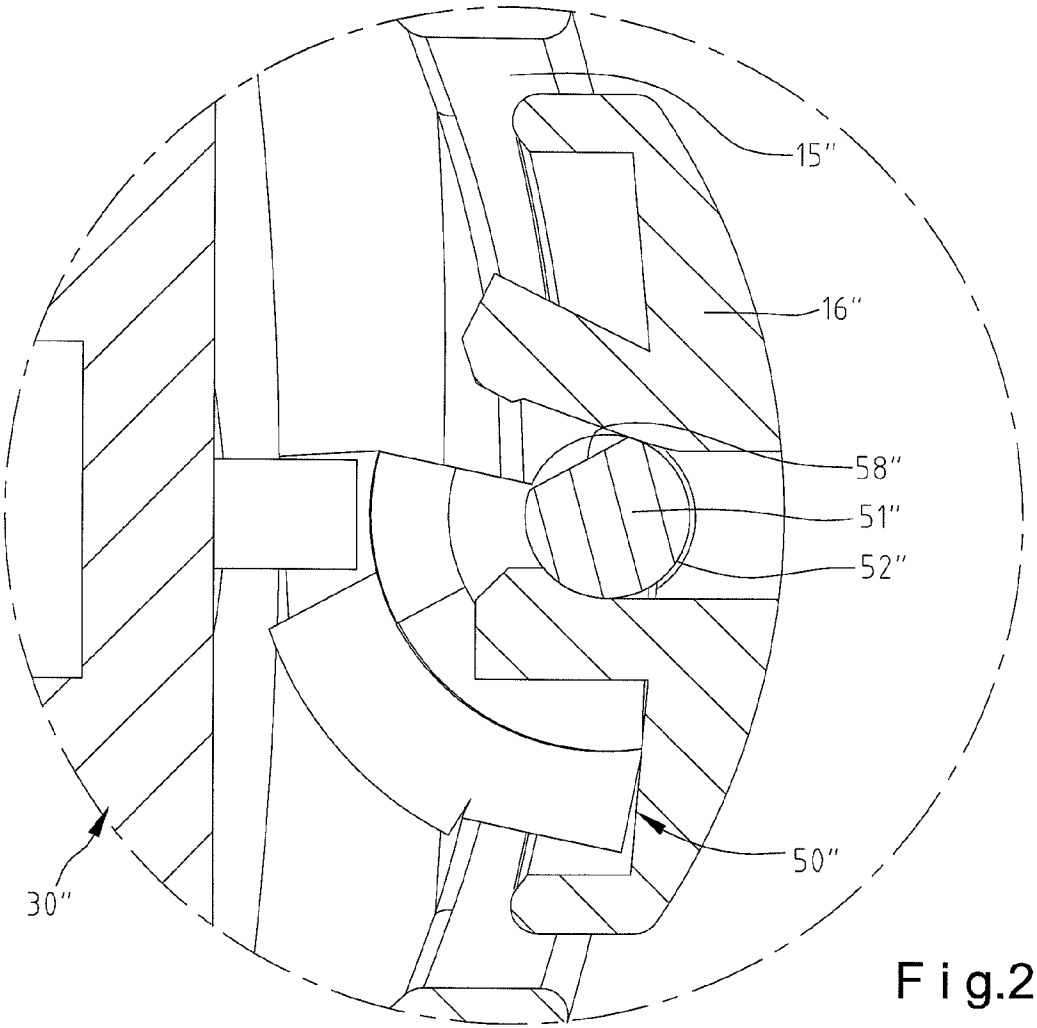
FIG. 20 is an extended cross-sectional view of FIG. 19 and in which a force-applied member is in a pressed state.

FIGS. 17 through 21 show a film transfer tool 1" in accordance with a third embodiment of the present invention, wherein like numerals are employed to denote like components of the first embodiment, however bearing the double prime. The third embodiment differentiates from the first embodiment in that it includes an active member 50" including a spindle 51" which has two ends engaged in two pivotal connections 17" respectively. Additionally, the spindle 51" includes at least one end having an arcuate face 52" defining one peripheral side and a flat face 58" defining another peripheral side. Also, at least one pivotal connection 17" includes an arm including a flat side which engages with the flat face 58" of the spindle 51". The arm has a resilient characteristic, and when a force-applied member 38" is moved and the active member 50" is pivoted, the arm is thereafter urged outwardly by the spindle 51" (as shown in FIG. 20).

Figure 21:
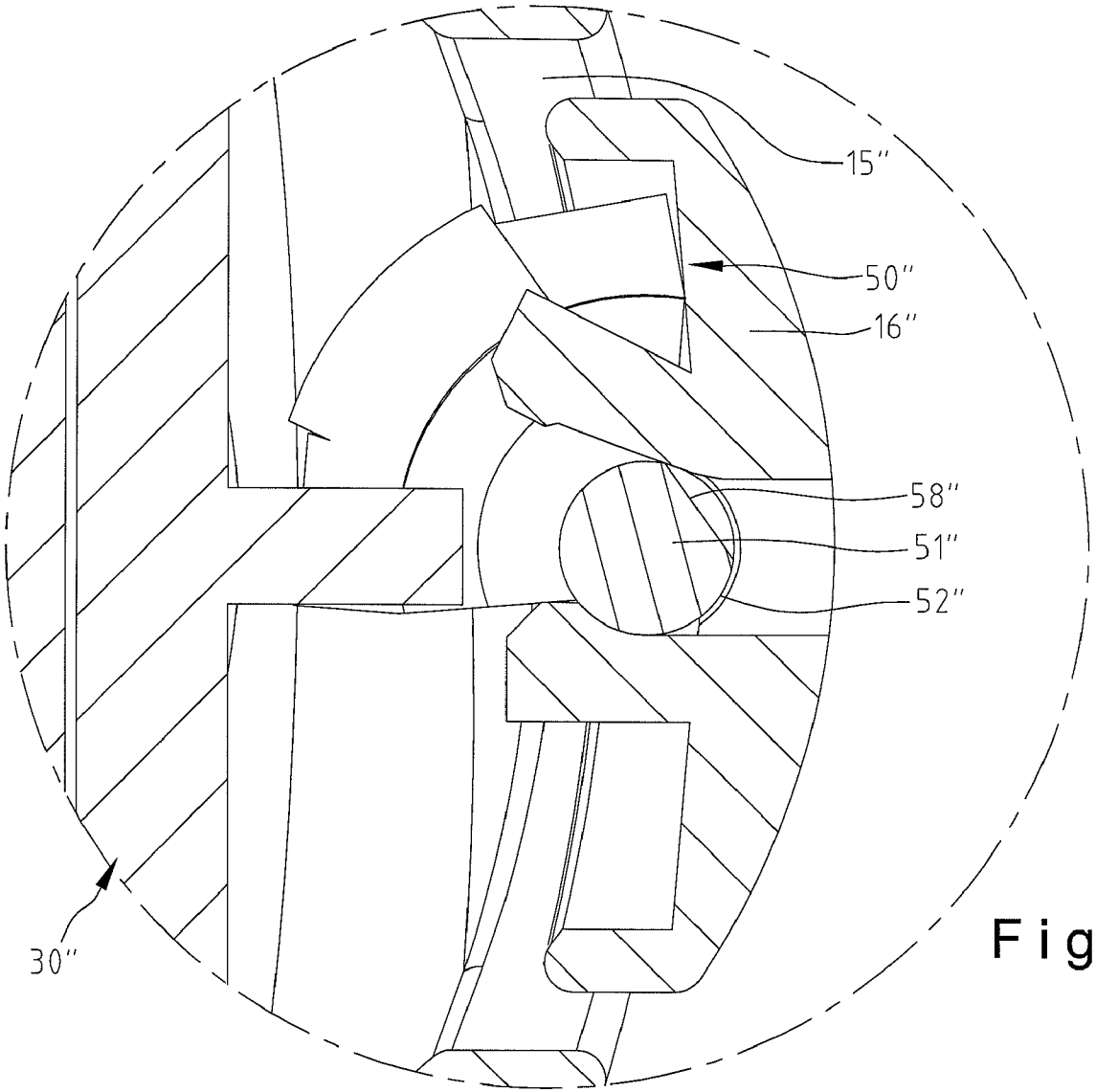
FIG. 21 is an extended cross-sectional view of FIG. 20 and in which the force applied member is in a recoiled state.

When an application head 33' is retained and extended outside the first and second shells 10' and 20', the flat face 58" of the spindle 51" is engaged with the flat side of the arm. Thus, the arm is returned to an unbiased position. It is understood that the flat face 58" facilitates the return of the arm. When the force-applied member 38" is continuously moved to release the first and second stopping members 36" and 37" from retained engagement with the active member 50", the arm is urged outwardly by the spindle 51" again (as shown in FIG. 21). After the first and second stopping members 36" and 37" are released from retained engagement with the active member 50" and the application head 33" is stowed inside first and second shells 10" and 20", the arm is returned to the unbiased position.

The first and second shells 10, 10', 10" and 20, 20', 20" of the film transfer tools 1, 1' and 1" are utilized for housing the reel assembly 30, 30' and 30", the elastic element 40, 40' and 40" and the active member 50, 50' and 50". The force-applied members 38, 38' and 38" are exposed outside the first and second shells 10, 10', 10" and 20, 20', 20". The first and second stopping members 36, 36', 36" and 37, 37', 37" on the reel assembly 30, 30' and 30" are engagable with the active member 50, 50' and 50" and are utilized to pivot the active member 50, 50' and 50". The first stopping member 36, 36', 36" is moveable on the passage 57, 57', and 57" of the active member 50, 50' and 50" and is retained on the active member 50, 50' and 50" in order to enable the application head 33, 33', and 33" to extend outside the first and second shells 10, 10', 10" and 20, 20', 20". When the force-applied member 38, 38', 38" is continuously moved, the first stopping member 36, 36', and 36" are released from a retained position with respect to the active member 50, 50' and 50", and the reel assembly 30, 30' and 30" is biased by the return of the elastic element 40, 40' and 40" and is stowed inside the first and second shells 10, 10', 10" and 20, 20', 20".

Accordingly, the film transfer tool 1, 1' and 1" of the present invention has the following objects:

First, by operating the force-applied member 38, 38', and 38", the reel assembly 30, 30' and 30" is moved. The first and second stopping members 36, 36', 36" and 37, 37', 37" on the reel assembly 30, 30' and 30" are selectively engagable with the active member 50, 50' and 50" for moving the film transfer tool 1, 1' and 1" between exposed and stowed positions. These essential components of the present invention have simple structures, and the active member 50, 50' and 50" is adapted to be injection molded for accomplishing a goal for mass production in a rapid manner and for reducing the cost thereof.

Second, the film transfer tool 1, 1' and 1" has a simple structure, and the cost of manufacturing is saved. Thus, the film transfer tool 1, 1' and 1" is very economical.

What is claimed is:

1. A film transfer tool comprising:

a housing including a first end, a second end, a substantially U-shaped groove in vicinity to the second end, and an elastic plate surrounded by the U-shaped groove;

a reel assembly mounted in the housing and including an application head and a force-applied member, with the application head disposed in proximity to the first end of the housing, with the force-applied member disposed in proximity to the second end of the housing, with the reel assembly including a wall from which a first stopping member is extended;

an elastic element incorporated with the reel assembly and restrained in the housing; and an active member including a locking section and a looped passage and pivotally mounted on the elastic plate of the housing, wherein pivoting of the active member urges the elastic plate outwardly, wherein the force-applied member is operably moved to urge the reel assembly toward the first end of the housing and to enable the application head to extend outside the housing, wherein the first stopping member urges the active member and is moved into the looped passage and is retained at the locking section, and wherein the first stopping member is disengaged from the locking section and is moved to the looped passage thereafter and the reel assembly is moved toward the second end of the housing thereafter in order to stow the application head inside the housing.

2. The film transfer tool as claimed in claim 1 wherein the looped passage includes an entry track, an exit track and a pivoting track, wherein the locking section is in proximity to the entry track and is between the entry track and the exit track, and wherein the pivoting track is urged by the first stopping member, the first stopping member is moved into the entry track and is past the entry track thereafter and is retained in the locking section thereafter and is disengaged from the locking section and moved into the exit track thereafter when the force-applied member is moved.

3. The film transfer tool as claimed in claim 2 wherein the active member includes a first end and a second end, with the first end in proximity to the first end of the housing and the second end in proximity to the second end of the housing, wherein the active member includes a spindle, and wherein the entry track is slanted away from the spindle as the entry track extends from the second end to the first end of the active member.

4. The film transfer tool as claimed in claim 2 wherein the looped passage includes a guiding track, with the guiding track disposed between the locking section and the exit track.

5. The film transfer tool as claimed in claim 2 wherein the looped passage includes a guiding section, wherein the entry track includes a finishing end, and wherein the guiding section is disposed at the finishing end of the entry track and is in proximity to the locking section.

6. The film transfer tool as claimed in claim 2 wherein the first stopping member includes two slanted edges at two ends thereon respectively, and wherein the two slanted edges facilitate movement of the first stopping member on the looped passage.

7. The film transfer tool as claimed in claim 2 wherein the active member includes a stopping section, wherein the entry track includes a starting end, wherein the stopping section is in proximity to the starting end, wherein the reel assembly includes a second stopping member, wherein the first stopping member is extended from a wall of the reel assembly at a first height whereas the second stopping member is extended from the same wall of the reel assembly at a second height, with the second height greater than the first height, wherein the second stopping member is stopped by the stopping section when the first stopping member is moved past the entry track of the looped passage, thereby restricting movement of the reel assembly.

8. The film transfer tool as claimed in claim 2 wherein the active member includes an urged section, wherein the reel assembly includes a second stopping member, and wherein the first stopping member is extended from a wall of the reel assembly at a first height whereas the second stopping member is extended from the same wall of the reel assembly at a second height, with the second height greater than the first height, and wherein the second stopping member is abutted by the urged section when the first stopping member is disengaged from the locking section, thereby the reel assembly is moved into the exit track.

9. The film transfer tool as claimed in claim 7 wherein the first stopping member includes two slanted edges at two ends thereon respectively, wherein the second stopping member includes an end in proximity to the first stopping member and having a third slanted edge, and wherein the slanted edges facilitate movement of the first and second stopping members on the looped passage.

10. The film transfer tool as claimed in claim 8 wherein the first stopping member includes two slanted edges at two ends respectively, wherein the second stopping member includes an end in proximity to the first stopping member and having a third slanted edge, and wherein the slanted edges facilitate movement of the first and second stopping members on the looped passage.

11. The film transfer tool as claimed in claim 1 wherein the elastic plate includes two pivotal connections formed on an inner surface of the elastic plate restraining the active member in the housing and with the active member pivotal with respect to the two pivotal connections.

12. The film transfer tool as claimed in claim 1 wherein the housing includes an opening at the second end, and wherein the force-applied member is disposed on the reel assembly and is opposite to the application head and extends outside of the second end of the housing.

13. The film transfer tool as claimed in claim 1 wherein the housing includes a wall and a through slot disposed on the wall, and wherein the force-applied member is extended from a side of the reel assembly and is inserted through the through slot.

14. The film transfer tool as claimed in claim 13 wherein the force-applied member includes a protruding section inserted through the through slot on the housing and a pushing member engaged with the protruding section.

15. The film transfer tool as claimed in claim 1 wherein the active member includes a spindle having two ends, wherein the elastic plate of the housing includes two pivotal connections pivotally receiving the two ends of the active member respectively, wherein the spindle includes at least one end having an arcuate face defining one peripheral side and a flat face defining another peripheral side, and wherein at least one pivotal connection includes an arm including a flat side which engages with the flat surface of the spindle.

16. The film transfer tool as claimed in claim 1 wherein the housing includes a first shell and a second shell, with the first and second shells connected to each other.

* * * * *